US009331429B2

(12) United States Patent
Choi et al.

(10) Patent No.: US 9,331,429 B2
(45) Date of Patent: May 3, 2016

(54) SHIELD AND LOCKING TYPE BOARD TO BOARD CONNECTOR

(71) Applicant: UJU ELECTRONICS CO., LTD., Hwaseong-si, Gyeonggi-do (KR)

(72) Inventors: Suk-Jin Choi, Hwaseong-si (KR); Guen-O Lee, Suwon-si (KR)

(73) Assignee: UJU ELECTRONICS CO., LTD., Gyeonggi-Do (KR)

( * ) Notice: Subject to any disclaimer, the term of this patent is extended or adjusted under 35 U.S.C. 154(b) by 7 days.

(21) Appl. No.: 14/141,907

(22) Filed: Dec. 27, 2013

(65) Prior Publication Data

US 2015/0132985 A1 May 14, 2015

(30) Foreign Application Priority Data

Nov. 8, 2013 (KR) ..... 10-2013-0135294

(51) Int. Cl.
*H01R 13/633* (2006.01)
*H01R 13/627* (2006.01)
*H01R 12/73* (2011.01)

(52) U.S. Cl.
CPC ..... *H01R 13/6335* (2013.01); *H01R 13/6275* (2013.01); *H01R 12/73* (2013.01)

(58) Field of Classification Search
CPC ..... H01R 12/88; H01R 12/716; H01R 12/57; H01R 13/214; H01R 13/506; H01R 13/6585; H01R 13/6581; H01R 13/6594; H01R 13/6658; H01R 13/6587; H01R 13/6275; H01R 24/00; H01R 9/096; H01R 9/09
USPC ..... 439/65, 626, 44, 74, 660, 345, 292, 439/310, 607.35, 607.01
See application file for complete search history.

(56) References Cited

U.S. PATENT DOCUMENTS

| | | | | |
|---|---|---|---|---|
| 5,558,528 | A * | 9/1996 | Cheng et al. | 439/160 |
| 6,394,841 | B1 * | 5/2002 | Matsuura | 439/607.23 |
| 7,585,185 | B2 * | 9/2009 | Obikane | 439/607.01 |
| 8,840,407 | B2 * | 9/2014 | Nose et al. | 439/74 |
| 8,968,005 | B2 * | 3/2015 | Hirakawa | 439/65 |
| 2013/0323971 | A1 * | 12/2013 | Kimura | H01R 12/71 439/607.22 |

* cited by examiner

*Primary Examiner* — Amy Cohen Johnson
*Assistant Examiner* — Oscar C Jimenez
(74) *Attorney, Agent, or Firm* — IPLA P.A.; James E. Bame

(57) ABSTRACT

A shield and locking type board to board connector functioning to connect a first board and a second board to each other, the connector including: a first connector unit having both a first base and a first terminal; a second connector unit having a second base and a second terminal; two shield members each having a shell shape, the shield members respectively provided on front and rear bases facing the second base such that the shield members arrest EMI (electromagnetic interference) noise; and a locking member provided in the second connector unit so as to prevent the first connector unit from being removed outward by an outward movement thereof after the first connector unit is combined with the second connector unit in a close contact state.

13 Claims, 10 Drawing Sheets

SHIELD AND LOCKING TYPE BOARD TO BOARD CONNECTOR

CROSS REFERENCE

This application claims foreign priority under Paris Convention to Korean Patent Application No. 10-2013-0135294, filed 8 Nov., 2013, with the Korean Intellectual Property Office.

BACKGROUND OF THE INVENTION

1. Field of the Invention

The present invention relates, in general, to the construction of a board to board connector and, more particularly, to a shield and locking type board to board connector, which includes a shield member having a locking member stop part, and can avoid a generation of EMI (electromagnetic interference) that may be caused during an operation of the boards and can prevent undesired disassembly of a female connector unit and a male connector unit of the board to board connector after assembling the connector units.

2. Description of the Related Art

Generally, a board to board (BtoB) connector is used to connect circuit boards that are printed with a variety of circuits to each other. As shown in FIG. 1, the board to board connector includes a male connector unit 10 and a female connector unit 20, in which the male connector unit 10 and the female connector unit 20 can be assembled with each other by inserting the male connector unit 10 into the female connector unit 20.

Once the male connector unit 10 and the female connector unit 20 are assembled with each other, the two connector units 10 and 20 should be maintained in the assembled state. However, after being assembled, the two connector units 10 and 20 may be undesirably disassembled from each other by an external force. To prevent the undesired disassembly of the two connector units 10 and 20, snap protrusions may be formed on respective terminals 12 and 14 of the two connector units 10 and 20 such that the protrusions face and can snap to each other, as shown in FIG. 1. When the protrusions elastically snap to each other after passing over each other, a locking force is formed in the assembled connector units 10 and 20.

However, the terminals 12 and 14 are made of a metal and have metallic elasticity, so, even when assembling the two connector units 10 and 20 with each other as described above, the terminals may be elastically deformed by an external force exceeding a predetermined level, so the terminals may move in directions in which the terminals gradually recede from each other. In the above case, even when the connector is slightly impacted or dropped, the male and female connector units may be easily disassembled from each other. Further, during a process of assembling the male and female connector units, it is not easy to know when assembly of the connector units is complete by vibrations, noise, or a so-called "click" when the units are "snapped" into place.

In an effort to solve the problems experienced in the conventional technology, the sizes and shapes of the snap protrusions may be somewhat exceedingly changed such that the change in the sizes and shapes of the protrusions can induce firm snapping of the protrusions and can generate a snap shock or snap noise. However, the change in the sizes and shapes of the protrusions is problematic in that the protrusions may not easily snap to each other. Further, when the connector units are assembled or disassembled, the snap protrusions having exceedingly changed sizes and shapes may be undesirably deformed or broken. Accordingly, when disassembling the male and female connectors so as to repair a device mounted on a circuit board, the connector units may be broken or devices soldered to boards, such as PCBs, may be undesirably separated from the boards.

The foregoing is intended merely to aid in the understanding of the background of the present invention, and is not intended to mean that the present invention falls within the purview of the related art that is already known to those skilled in the art.

SUMMARY OF THE INVENTION

Accordingly, the present invention has been made keeping in mind the above problems occurring in the related art, and the present invention is intended to propose a board to board connector, which has a shield member that can assemble the connector by a locking type method and construction instead of the conventional method and construction using a frictional snapping technology, and can avoid a generation of EMI (electromagnetic interference) of the connector.

The present invention is also intended to propose a board to board connector, which can improve the function of avoiding the generation of EMI using a simple ground structure provided at a location between a shield member and boards, thereby realizing a function of high speed signal transmission.

The present invention is further intended to propose a board to board connector, which can realize firm assembly of first and second connector units using only a locking member and a shield member, so that the present invention can prevent separation or disassembly of the connector units, and can enable a user to know the locked positions of the first and second terminals from the outside, and can realize an improvement in contact stability of the terminals, without requiring snap protrusions for increasing the terminal locking force unlike a conventional connector.

The present invention is further intended to propose a board to board connector, which can realize an improvement in the mechanical strength of a shell-shaped shield member due to the structure of the shield member.

The present invention is further intended to propose a board to board connector, in which the left to right width of a first board may be configured to be smaller than the left to right width of a first connector unit, so the present invention can realize a great improvement in reworkability of the connector.

The present invention is further intended to propose a board to board connector, in which the locking member can be easily seated and assembled in the connector, and the locking operation of the locking member can be completed when the male and female connector units are assembled, without requiring a user to handle or control the locking member during the process of assembling the male and female connector units.

The present invention is further intended to propose a board to board connector, in which the locking member can be maintained in a locking standby position even before the locking member starts the locking operation, thereby realizing a simple locking motion.

In order to achieve the above object, according to one aspect of the present invention, there is provided a shield and locking type board to board connector functioning to connect a first board and a second board to each other, the connector including: a first connector unit having both a first base and a first terminal; a second connector unit having a second base and a second terminal; and two shield members each having a shell shape, the shield members respectively provided on front and rear bases facing the second base such that the shield members arrest EMI (electromagnetic interference) noise.

The board to board connector may further include: a locking member provided in the second connector unit so as to prevent the first connector unit from being removed outward by an outward movement thereof after the first connector unit is combined with the second connector unit in a close contact state.

Each of the shield members may include: a vertical part covering an outer surface of the front and rear bases; a horizontal part integrated with the vertical part and covering an upper surface of the front and rear bases; at least one ground protrusion formed on a lower edge of the vertical part; and a locking member stop part formed by being bent vertically downward in each of opposite ends of the horizontal part.

The locking member may include: a lower rib; opposite vertical sides formed on opposite ends of the lower rib; an upper rib formed between upper ends of the opposite vertical sides; and a pressure protrusion extending from the lower rib by being bent in a direction, wherein, when the pressure protrusion is pressed downward, the opposite vertical sides and the upper rib may be turned based on the lower rib, and when the upper rib is turned, the upper rib may be placed on an outside end of a hooked part of the first connector unit, so the locking member may hold the first connector unit and may prevent the first connector unit from being removed.

Here, the second connector unit may be provided with a locking part in each of opposite ends of the second base, wherein the locking part includes: a depression that is open upward; and a seat closed by a support part at an upper end thereof, wherein the lower rib of the locking member is seated in the seat so as to support the locking member in such a way that the locking member can be turned around the seat, and a part of the first connector unit is inserted into the depression, wherein, when the pressure protrusion is pressed down, the locking member is turned around the lower rib, and the upper rib is moved to a position at which the upper rib holds the outside end of the hooked part of the first connector unit.

The first connector unit may include: a pressure part formed on the first base at a position facing the second base; and the hooked part formed on the first base at a position opposite to the pressure part, wherein, when the first connector unit and the second connector unit are brought into close contact with each other, the pressure part of the first connector unit is inserted into the depression, and when the pressure protrusions of the locking member is pressed down, the locking member is turned around the lower rib seated in the seat, and the upper rib is moved to the position at which the upper rib holds the outside end of the hooked part.

Further, in the board to board connector, a space may be formed inside the support part of the locking part such that the space is open upward and sideward, and the lower rib of the locking member may be inserted downward into the space of the support part, and may be moved outward on a bottom surface of the space of the support part so as to be seated in the seat.

Further, a vertical insert hole may be formed in a lower end of the space of the support part, so, when a lower end of the locking member stop part is inserted into the vertical insert hole, the locking member stop part pushes the lower rib into the seat in the space of the support part.

Further, a first ground protrusion may be formed on each of opposite ends of the lower edge of the vertical part of each of the shield members, and a plurality of second ground protrusions may be formed on the lower edge of the vertical part at spaced locations between the first ground protrusions formed on the opposite ends of the vertical part, and first ground terminals may be formed on a second board that is placed below the shield members such that the first ground terminals are electrically connected to the first ground protrusions, and a plurality of second ground terminals may be formed between the first ground terminals on the second board at locations corresponding to the plurality of second ground protrusions.

Further, electric terminals may be arranged on the second board in a line along with the first and second ground terminals so as to be electrically connected to the second terminals, wherein the second ground terminals may further protrude outward than the electric terminals.

The second terminals and the second ground protrusions may be commonly connected to the second ground terminals.

Further, a U-shaped contact part of the first terminal which is not soldered to the first board may be provided with a recessed main contact point and a protruding sub-contact point at opposite positions on an outer surface, and a U-shaped contact part of the second terminal which is not soldered to the second board may be provided with a main contact point protrusion and a sub-contact point surface at opposite positions on an inner surface, in which the sub-contact point surface has a vertical surface shape, the main contact point protrusion corresponds to the recessed main contact point, and the sub-contact point surface corresponds to and is guided by the protruding sub-contact point.

Further, the left to right width of the first board may be smaller than the left to right width of the first connector unit.

The board to board connector may further include an axial bent part formed in the vertical part of the shield member.

The present invention is advantageous in that the invention can avoid generation of EMI (electromagnetic interference) of the connector during an operation of the boards and can firmly lock the male and female connector units to each other without requiring a user to separately handle or control the locking member.

The present invention is also advantageous in that the invention can improve the function of avoiding generation of EMI using a simple ground structure, thereby realizing the function of high speed signal transmission.

The present invention is further advantageous in that the invention can enable a user to know the locked positions of the first and second terminals from the outside, and can realize an improvement in contact stability of the terminals, without requiring snap protrusions for increasing the terminal locking force unlike a conventional connector.

Another advantage of the present invention resides in that the invention can realize an improvement in the mechanical strength of the shell-shaped shield member due to the structure of the shield member.

A further advantage of the present invention resides in that the invention can facilitate easy design of the size of each board according to operationality of the connector, thereby realizing a great improvement in reworkability of the connector.

Still another advantage of the present invention resides in that the assembly of the connector can be finished by simply inserting the male connector unit into the female connector unit in a state in which the locking member has been seated on the connector, so the invention has a simple construction and can realize easy locking of the male and female connector units.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Before the present invention is described in detail, it should be noted that the present invention may be embodied in many different forms without departing from the spirit and significant characteristics of the present invention. Therefore, the embodiments of the present invention are disclosed only for illustrative purposes and should not be construed as limiting the present invention.

It will be understood that, although the terms "first," "second," etc. may be used herein to describe various elements, these elements should not be limited by these terms.

These terms are only used to distinguish one element from another element. For instance, a first element discussed below could be termed a second element without departing from the teachings of the present invention. Similarly, the second element could also be termed the first element.

It will be understood that when an element is referred to as being "coupled" or "connected" to another element, it can be directly coupled or connected to the other element or intervening elements may be present therebetween.

In contrast, it should be understood that when an element is referred to as being "directly coupled" or "directly connected" to another element, there are no intervening elements present.

The terminology used herein is for the purpose of describing particular embodiments only and is not intended to be limiting. As used herein, the singular forms are intended to include the plural forms as well, unless the context clearly indicates otherwise.

It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Unless otherwise defined, all terms including technical and scientific terms used herein have the same meaning as commonly understood by one of ordinary skill in the art to which this invention belongs.

It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinbelow, exemplary embodiments of the present invention will be described in detail with reference to the accompanying drawings such that the invention can be easily embodied by one of ordinary skill in the art to which this invention belongs.

Figure 1:
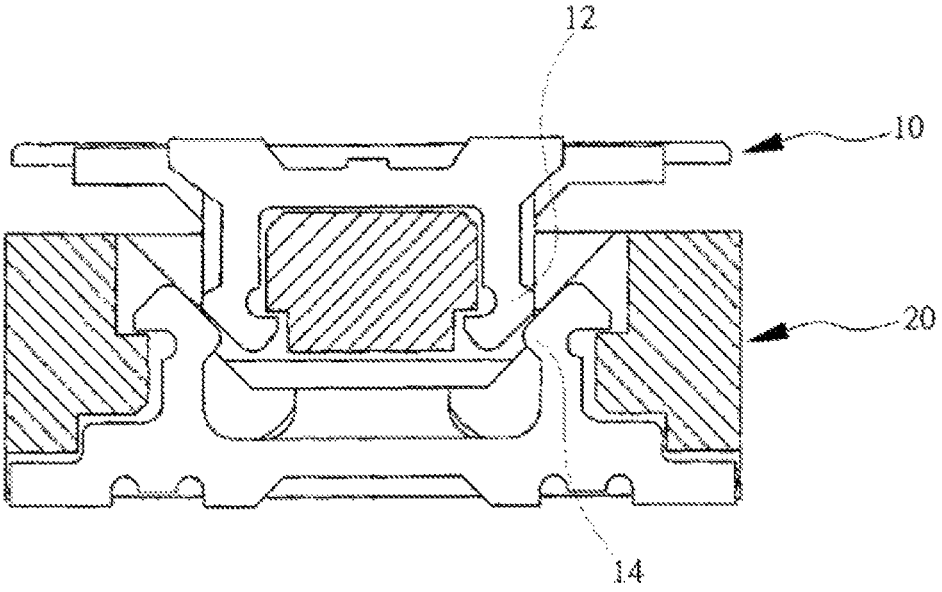
FIG. 1 Prior Art
FIG. 1 is a sectional view of a conventional board to board connector.
Figure 2:
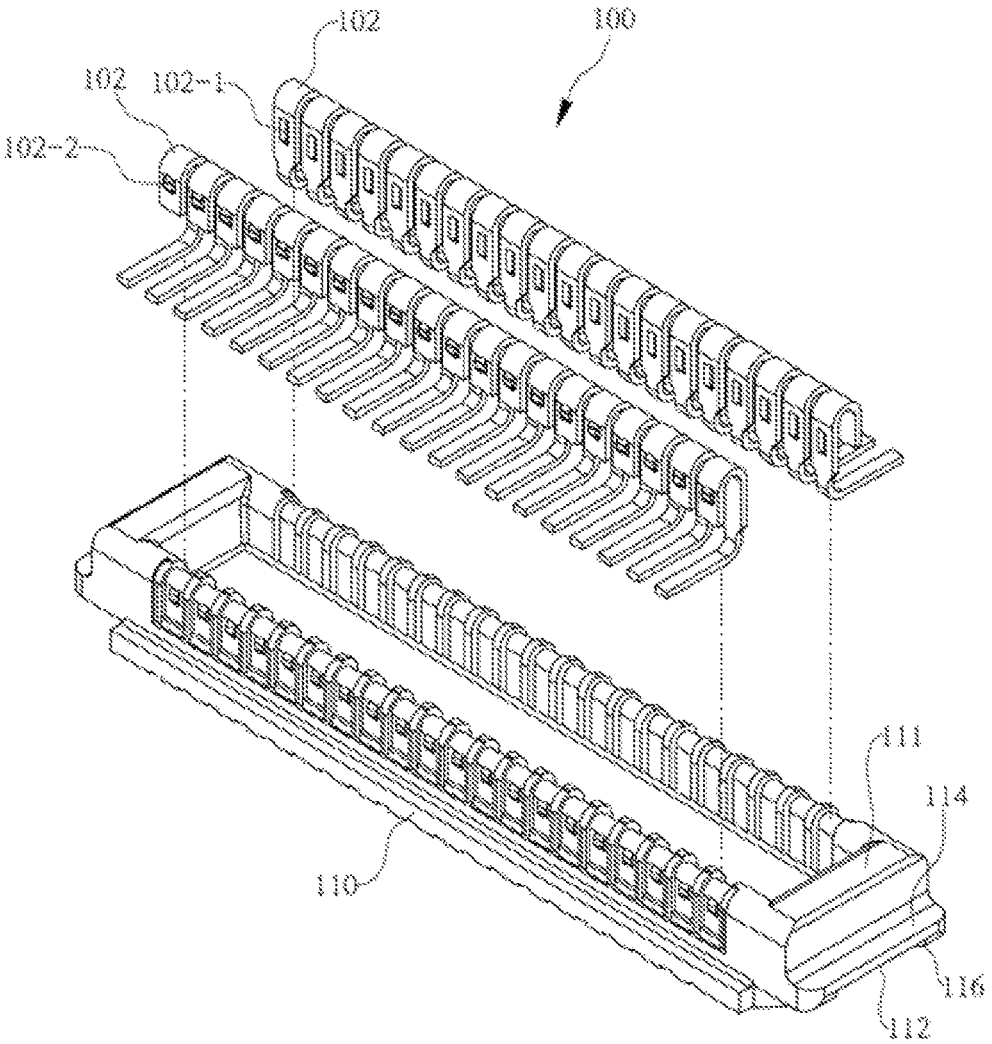
FIG. 2 is an exploded perspective view of a first connector unit according to the present invention.

FIG. 2 is a view illustrating a first connector unit according to the present invention in an exploded state. As shown in FIG. 2, the first connector unit 100 functioning as a male connector unit includes a first base 110 that is made of a synthetic resin material and is electrically insulated, in which a plurality of first terminals 102 are regularly arranged on the first base 110 in a line.

Each end of the first base 110 may be provided with an end part 112, a pressure part 111, a hooked part 116 and a step part 114, in which the end part 112 is formed on the end surface of the first base 110, the pressure part 111 is formed at a position facing a second connector unit 200, the hooked part 116 is formed at a position opposite to the pressure part 111, and the step part 114 is formed by being stepped inward at a position between the end part 112 and the pressure part 111.

Further, each of the first terminals 102 has a U-shaped contact part, in which a main contact point 102-1 having a recessed shape and a sub-contact point 102-2 having a protruding shape are formed on the outer surface of the U-shaped contact part at opposite locations. When the first connector unit 100 is closely assembled with a second connector unit 200, as will be described later herein, the main contact points 102-1 and the sub-contact points 102-1 of the first terminals 102 realize electric contact with second terminals 202 of the second connector unit 200.

Figure 3:
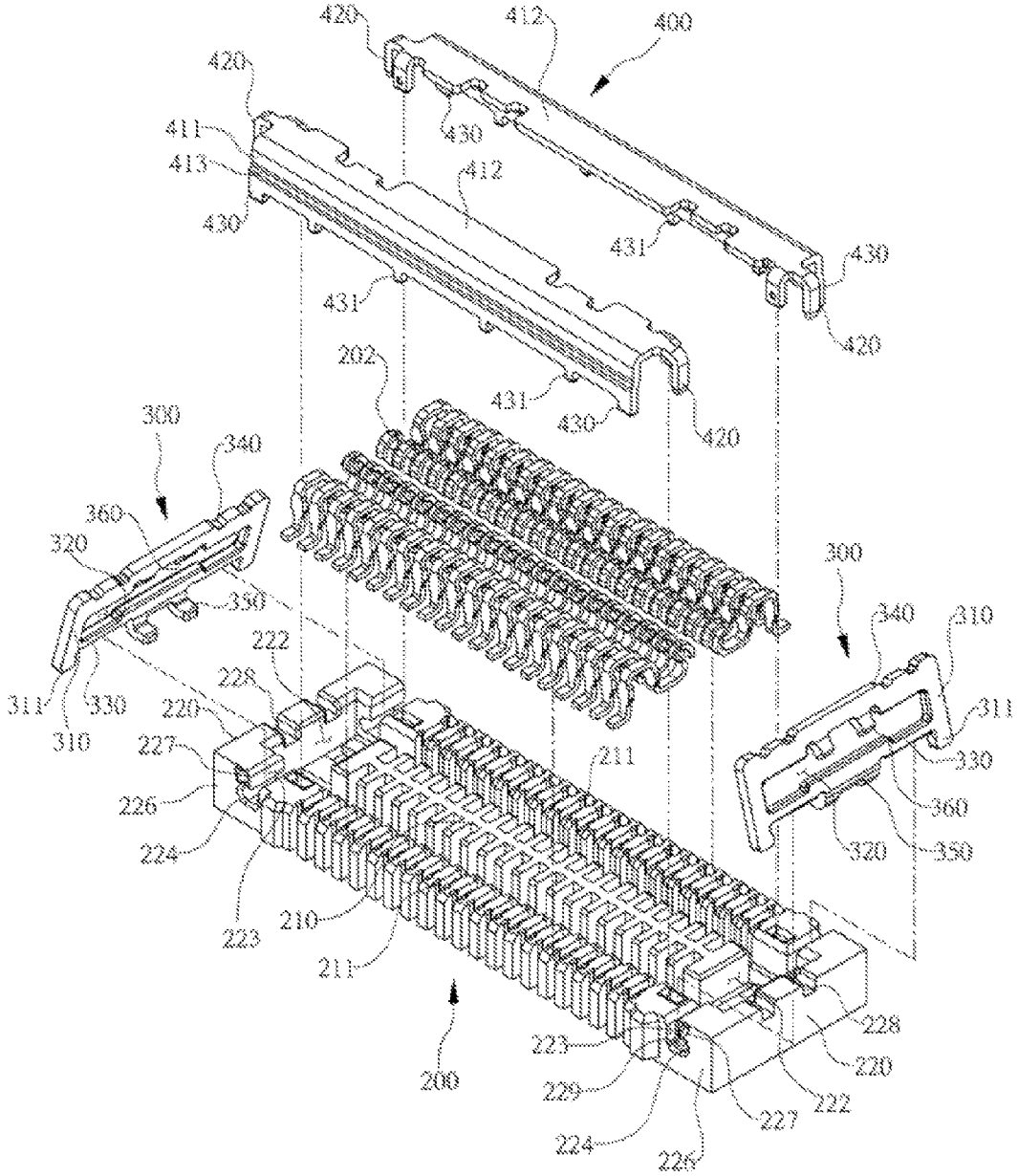
FIG. 3 is an exploded perspective view illustrating a second connector unit and a locking member according to the present invention.

FIG. 3 is a view illustrating the second connector unit and a locking member according to the present invention in an exploded state. As shown FIG. 3, the second connector unit 200 functioning as a female connector unit includes a second base 210 that is made of a synthetic resin material and is electrically insulated, in which a plurality of second terminals 202 are regularly arranged along opposite front and rear bases 211 in a line on the second base 210 in a left to right direction.

In the description, the term "left to right" is used to describe an axial direction of each of the first and second connector units which extends from the left-hand side to the right-hand side of the drawings, and the term "front and rear" is used to describe a direction crossing the left to right direction horizontally and perpendicularly.

Here, in the front and rear sides of the second connector unit 200 which are relatively long, the front and rear bases 211 are formed, with shell-shaped shield members 400 made of a metal respectively installed on the front and rear bases 211.

The front and rear bases 211 are oppositely arranged along the front and rear sides of the second connector unit 200 based on a central base (not shown), and form a rectangular box shape with the exception of a plurality of grooves (not shown) in which the plurality of second terminals 202 are inserted.

Each of the shell-shaped shield members 400 has a "¬" shape (front shield member) or an "L" shape (rear shield member), and includes a vertical part 411 that covers the front or rear surface of the front and rear bases 211, and a horizontal part 412 that is integrated with the vertical part 411 and covers the upper surface of the front and rear bases 211.

Further, a plurality of first and second ground protrusions 430 and 431 are formed along the lower edge of the vertical part 411 of each of the shield members 400. The first and second ground protrusions 430 and 431 are connected and grounded to first and second ground terminals 2-2 and 2-3 of a second board 2.

Further, in the left and right ends of the horizontal part 412, respective locking member stop parts 420 are formed by being bent vertically downward, so the locking member stop parts 420 can prevent an undesired movement or separation of locking members 300 during an operation of the locking members 300, as will be described later herein. In other words, when the shield members 400 are assembled with the second connector unit 200, the lower ends of the locking member stop parts 420 are inserted into vertical insert holes 229 of locking parts 220, so the locking member stop parts 420 are locked to the locking parts 220, and can prevent an undesired movement or separation of the locking members 300.

Here, each of the shell-shaped shield members 400 according to the present invention has the vertical part 411 and the horizontal part 412 which have rectangular plate shapes, so the shell-shaped shield members 400 can be structurally reinforced and have an increased structural strength, thereby being prevented from being bent even when an external shock is applied to the shield members 400. Further, an axial bent part 413 is formed in the vertical part 411, so the mechanical strength of the shield members 400 can be increased.

In the left and right ends of the second connector unit 200, respective locking parts 220 are formed and respective locking members 300 are inserted and seated in the locking parts 220 in such a way that the locking members 300 oppositely face each other.

In each of the locking parts 220, a depression 222 is formed in the central area by being open upward. Further, a support part 226 is formed outside the depression 222, a seat 224 that is as a horizontal groove is formed in the lower part of the support part 226, and a space 223 is formed inside the support part 226 such that the space 223 is open upward and sideward and can separate the support part 226 from the front and rear bases 211 with which the second terminals 202 are assembled.

Further, a vertical insert hole 229 is formed through the lower end of the space 223 of each of the locking parts 220, so the lower ends of the locking member stop parts 420 are locked to the vertical insert hole 229 by being inserted thereinto.

Each of the locking members 300 has a rectangular frame shape that is formed by a horizontal lower rib 330, opposite vertical sides 310 extending vertically upward from opposite ends of the lower rib 330, a horizontal upper rib 340 horizontally extending between upper ends of the opposite vertical sides 310, and a "▭"-shaped locking hole 320 defined between the ribs and the vertical sides.

Further, pressure protrusions 350 are formed on the lower rib 330 in such a way that the pressure protrusions 350 protrude from the lower rib 330 and are bent inward so as to be directed toward the center of the second base 210. Here, the pressure protrusions 350 are bent at an angle of about 90 degrees relative to the vertical sides 310. The pressure protrusions 350 are placed in the depression 222 such that the pressure protrusions 350 are exposed upward.

Insert protrusions 360 are formed on the upper rib 340 in such a way that the protrusions 360 are directed outward to each end of the second base 210. The insert protrusions 360 may be seated in respective insert protrusion seats 228 that are formed in the upper surface of the outside edge of the depression 222.

In the present invention, although it is preferred that the locking member 300 has a rectangular frame shape with the locking hole 320 defined therein as shown in the drawings, the locking member 300 may be differently designed by bending the upper rib 340 or by deforming the shape of a plate such that the locking member 300 can perform the desired function thereof without having the locking hole when necessary.

The locking member 300 is inserted downward into the space 223 such that the lower rib 330 is placed down. After inserting the locking member 300 into the space 223, the locking member 300 is pushed outward in a direction toward the end of the locking part 220 so that the lower rib 330 is moved outward on the bottom surface of the space 223 so as to be seated in the seat 224. In the above state, the upper edge of the lower rib 330 is supported by the support part 226, so the locking member 300 can be turned around the lower rib 330 in a state in which the position of the lower rib 330 is maintained in the seat 224.

In the above state, the pressure protrusions 350 that are formed on the center part of the lower rib 330 are exposed outside the depression 222 such that the pressure protrusions 350 can be viewed from the top. When the lower rib 330 of the locking member 300 is seated in the seat 224, the opposite vertical sides 310 are inclinedly placed such that the opposite vertical sides 310 are inclined upward and outward, and the pressure protrusions 350 are inclinedly placed such that the pressure protrusions 350 are inclined inward in a direction toward the center of the second base 210. Here, when the locking member stop parts 420 are inserted into and locked to the vertical insert hole 229 of the locking part 220, the locking member stop parts 420 reduces the size of the space 233 and pushes the lower rib 330 into the seat 224, so the locking member stop parts 420 can prevent undesired movement or separation of the locking member 300.

Here, a reinforcing leg 311 extends downward from the lower end of each of the opposite vertical sides 310. The reinforcing legs 311 of the locking member 300 reinforce the combination effect of the locking part 220, the locking member 300 and the locking member stop parts 420 in the opposite ends of the space 223.

Figure 4A:
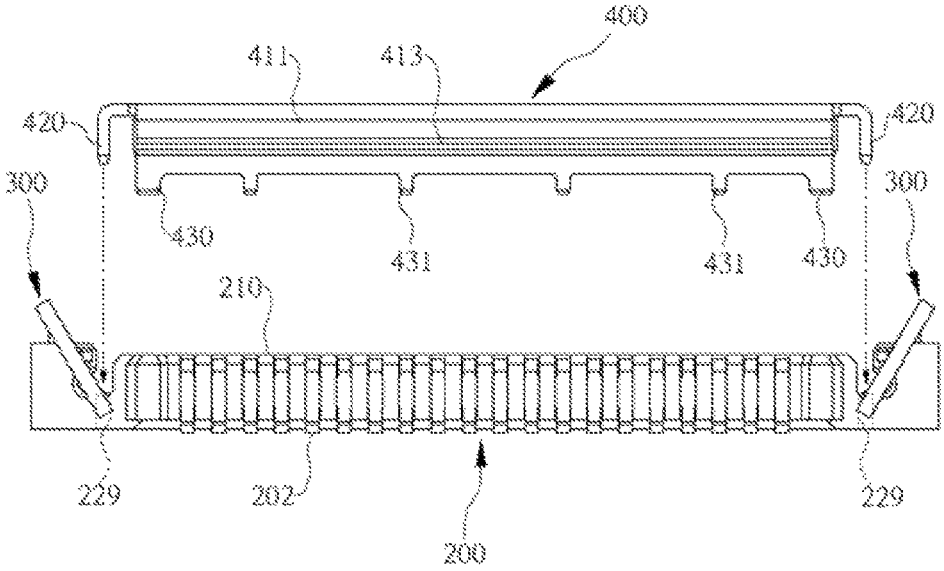
FIGS. 4A and 4B are views respectively illustrating states of shield members and the second connector unit of the present invention, before and after assembling.
Figure 4B:
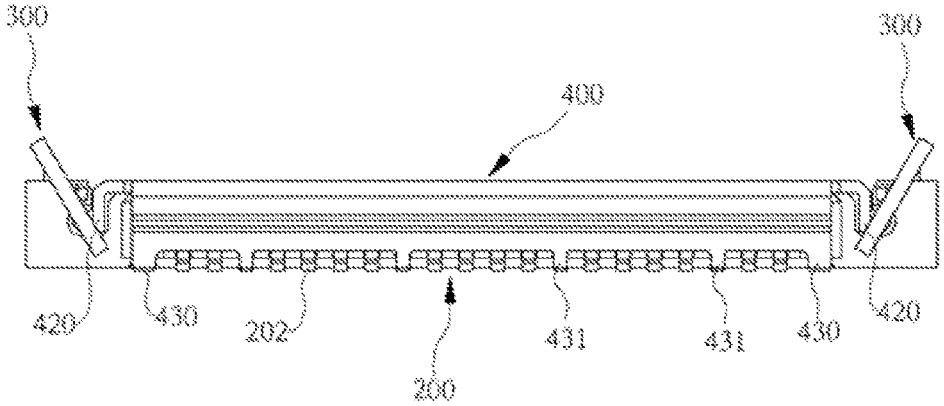

FIGS. 4A and 4B are views respectively illustrating states of the shield members and the second connector unit of the present invention, before and after assembling.

First, referring to FIG. 4A, in a state before assembling, the locking members 300 are maintained in an outward inclined state and the lower ends of the locking member stop parts 420 of the shield members 400 are placed to be directed to the vertical insert hole 229 of the locking part 220.

Thereafter, referring to FIG. 4B, in a state after assembling, the lower ends of the locking member stop parts 420 of the shield members 400 are inserted into the vertical insert hole 229 of the locking part 220, the vertical parts 411 of the shield members 400 cover the front and rear surfaces of the front and rear bases 211 of the second connector unit 200, and the horizontal parts 412 cover the upper surfaces of the front and rear bases 211.

As described above, on the lower edge of the vertical part 411 of each of the shield members 400, the plurality of first and second ground protrusions 430 and 431 protrude downward so as to be connected and grounded to the first and second ground terminals 2-2 and 2-3 of the second board 2 that is a lower board.

Here, because the shape of the lower end of each locking member stop part 420 of the shield members 400 is designed to be simply inserted into the vertical insert hole 229 of the locking part 220, the locking member 300 is maintained in the outward inclined state in the same manner as described for the state before assembling.

Figure 5A:
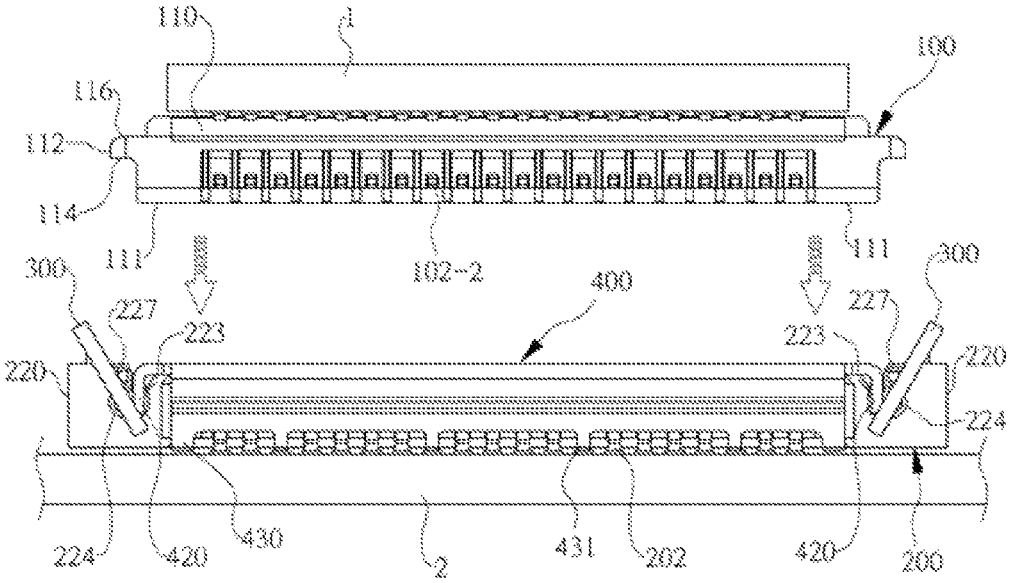
FIGS. 5A and 5B are views respectively illustrating states of the first connector unit and the second connector unit having the shield members according to the present invention, before and after assembling.
Figure 5B:
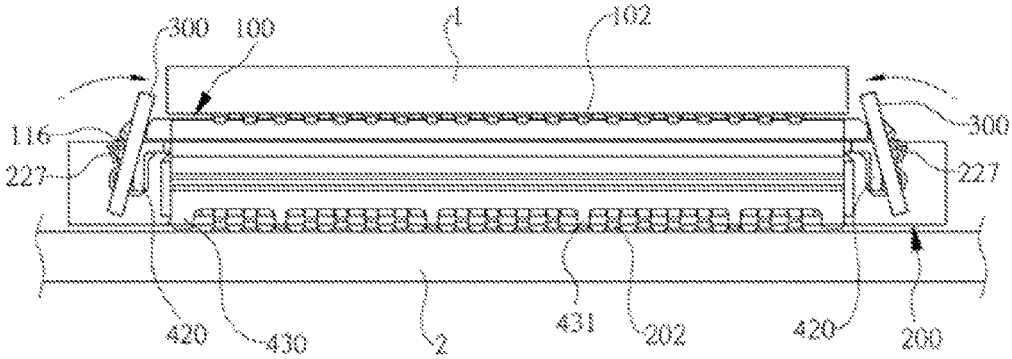

FIGS. 5A and 5B are views respectively illustrating states of the first connector unit and the second connector unit having the shield members according to the present invention, before and after assembling.

First, referring to FIG. 5A, in a state before assembling, the locking member 300 is maintained in an outward inclined position. However, referring to FIG. 5B, in a state after assembling, the locking member 300 has been turned inward around the lower rib 330, and holds the first connector unit 100.

The first connector unit 100 that has been soldered to the first board 1 is provided with the pressure parts 111 at the left and right ends of the first base 110 such that the pressure parts 111 face the second connector unit 200. The first connector unit 100 is also provided with the hooked parts 116 at upper positions opposite to the pressure parts 111. Here, it is preferred that the edges of the hooked parts 116 be rounded so as to allow easy engagement of the upper ribs 340 of the locking members 300 with the respective hooked parts 116.

When the first connector unit 100 is brought into close contact with the second connector unit 200, the locking members 300 are turned inward around the respective seats 224 in the same manner as in a levering motion, in which the locking members 300 cover the outside edges of the hooked parts 116, and are maintained in the covering states. Further, the locking member stop parts 420 of the shield members 400 are inserted into and locked to the vertical insert holes 229 of the opposite locking parts 220, so the locking member stop parts 420 push the lower ribs 330 into the respective seats 224. Accordingly, the first and second connector units 100 and 200 are not separated from each other before the locking members 300 are manipulated to be opened outward.

Here, as shown in FIG. 5B, the left to right width of the first board 1 that is placed on the first connector unit 100 is designed to be smaller than a distance between the two opposite locking members 300 or, in other words, than the left to right width the first connector unit 100, so the present invention can efficiently avoid interference between the locking members 300 and the first board 1 unlike a related art technology in which a first board having a length greater than the length of the first connector unit is used. Accordingly, the invention can facilitate easy design of the size of the first board associated with the first connector unit according to operationality of the connector, thereby realizing a great improvement in reworkability of the connector.

Figure 6A:
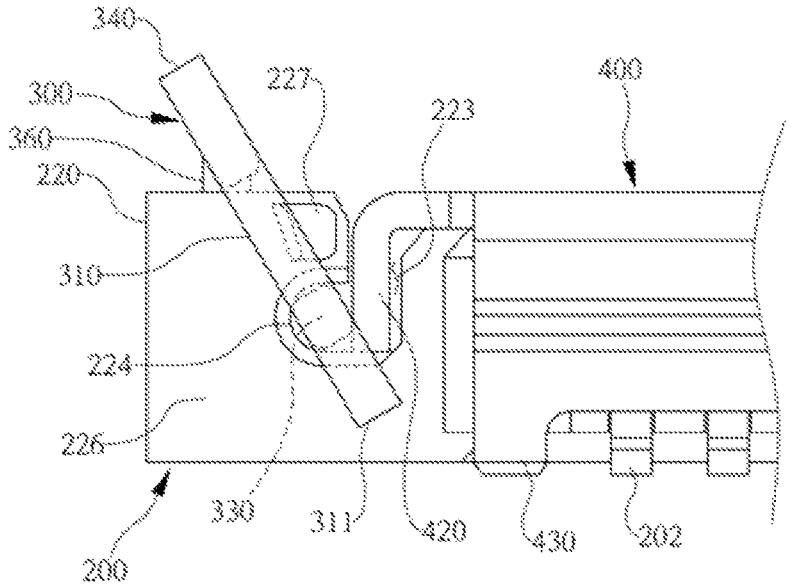
FIGS. 6A and 6B are enlarged views illustrating a state in which the locking member supports and locks the second connector unit having the shield members according to the present invention.
Figure 6B:
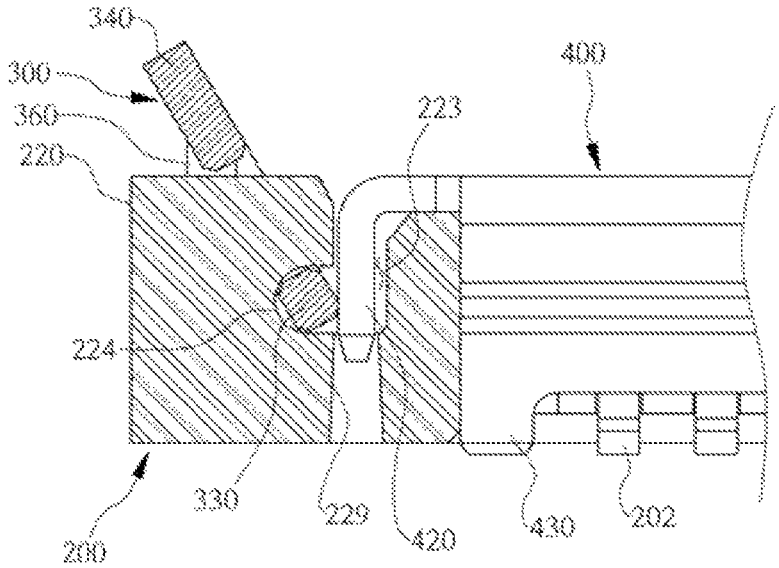

FIGS. 6A and 6B are enlarged views illustrating a state in which the locking member supports and locks the second connector unit having the shield members according to the present invention.

As shown in FIGS. 6A and 6B, the locking members 300 lock the first connector unit 100 to the second connector unit 200 in which the lower ribs 330 of the locking members 300 are held in the respective seats 224 and the upper ribs 340 hold the outside ends of the hooked parts 116. Further, the locking member stop parts 420 of the shield members 400 push the lower ribs 330 into the seats 224. In addition, stop protrusions 227 are formed on opposite side surface of each of the support parts 226, and hold the locking member 300 so as to maintain the locking position of the locking member 300. In a state before assembling, the stop protrusions 227 also function to maintain the open state of the locking members 300 without allowing the locking members 300 to be turned inward to a closed position. When the locking member 300 passes over the stop protrusions 227, fine vibrations, noise, or a so-called "click" is generated, so a user can efficiently know the motion of the locking member 300 without viewing the motion with naked eyes.

Figure 7A:
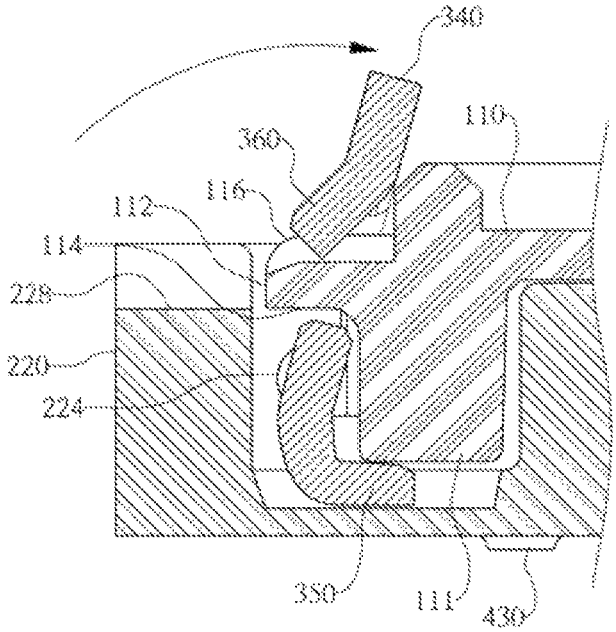
FIGS. 7A and 7B are sectional views illustrating a locking state and an unlocking state of the locking member according to the present invention.
Figure 7B:
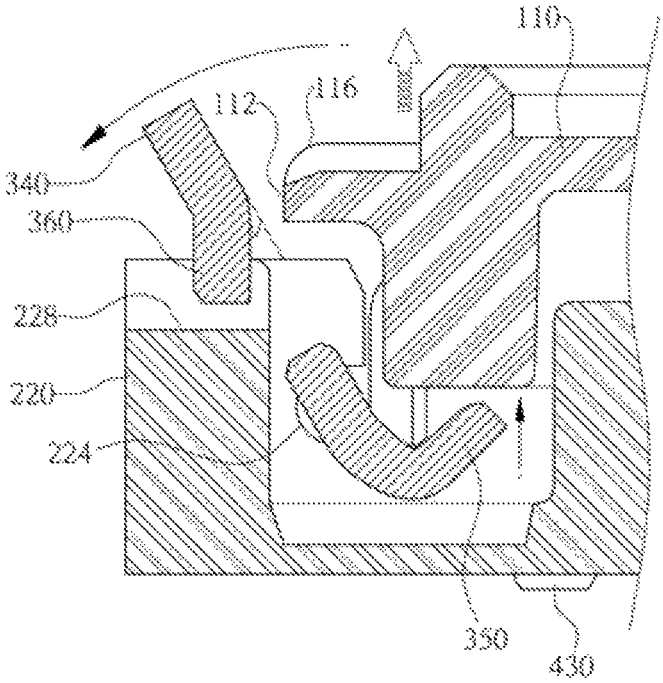

FIGS. 7A and 7B are sectional views illustrating a locking state and an unlocking state of the locking member according to the present invention. Referring to FIG. 7A, when the pressure part 111 presses the pressure protrusions 350, the locking member 300 is turned and, at the same time, the upper rib 340 approaches a position at which the upper rib 340 can cover the outside end of the hooked part 116. Further, in the above state, the locking member stop parts 420 of the shield members 400 push the exposed surface of the lower rib 330, so the locking member stop parts 420 can prevent the locking member 300 from being undesirably loosened or separated. In the drawings, reference numeral 360 denotes the insert protrusions 360.

Referring to FIG. 7B, when a user turns the locking member 300 outward such that the opposite vertical sides 310 can pass over the stop protrusions 227, the locking member 300 is turned in the same manner as in the levering motion around the lower rib 330 seated in the seat 224, so the pressure protrusions 350 push the pressure part 111 upward and, at the same time, the upper rib 340 is removed outward from the hooked part 116. Accordingly, the first connector unit 100 can be easily removed from the second connector unit 200.

Figure 8A:
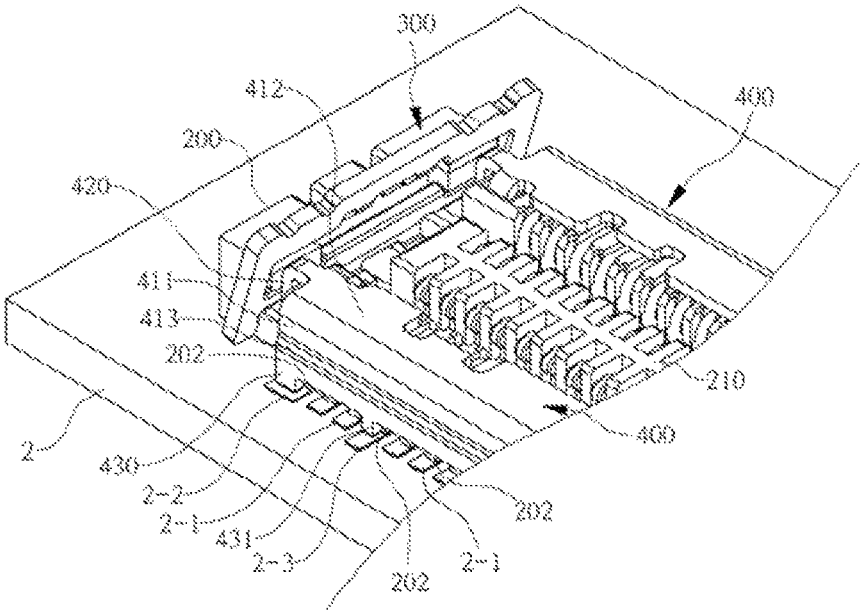
FIGS. 8A to 8C are views illustrating a grounded state formed to avoid a generation of EMI of shield members according to the present invention.
Figure 8B:
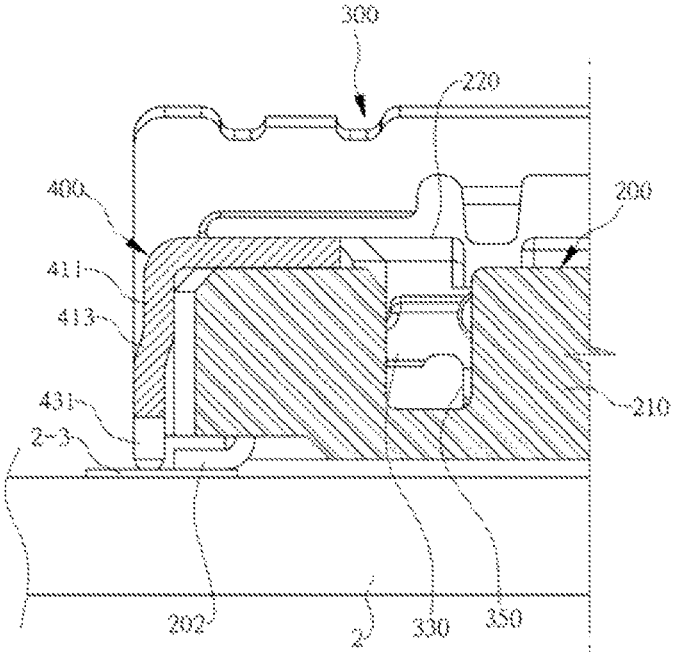
Figure 8C:
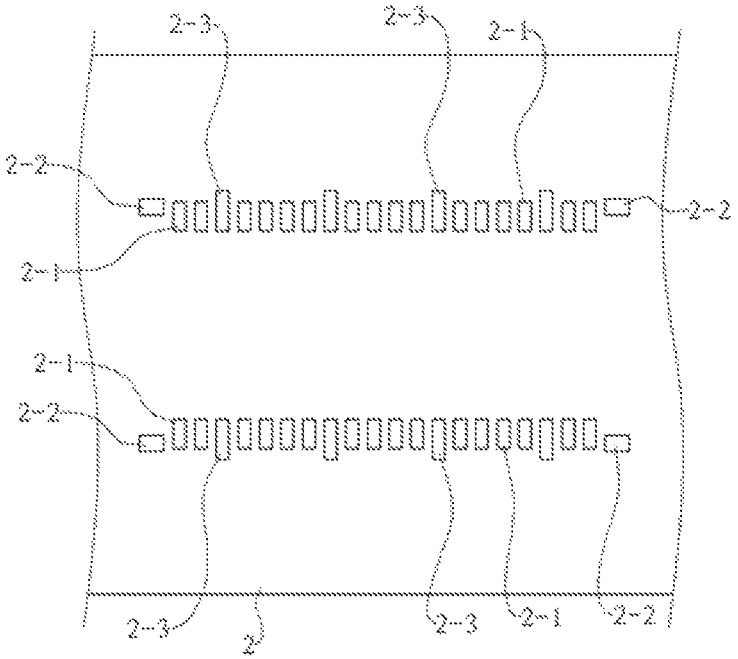

FIGS. 8A to 8C are views illustrating a grounded state formed to avoid a generation of EMI of the shield members according to the present invention.

First, as shown in FIGS. 8A to 8C, electric terminals 2-1 and the first and second ground terminals 2-2 and 2-3 are arranged on the second board 2 in two lines so as to be electrically connected to the second terminals 202.

Here, the first ground terminals 2-2 are connected and grounded to the first ground protrusions 430 that are formed on opposite ends of the lower edge of the vertical part 411 of each of the shield members 400, and the second ground terminals 2-3 are connected and grounded to the plurality of second ground protrusions 431 that are formed on the lower edge of the vertical part 411 of the shield members 400 at spaced locations between the first ground protrusions 430. Here, the second ground terminals 2-3 further protrude outward than the electric terminals 2-1 (about 0.2 mm), so the second terminals 202 and the second ground protrusions 431 are commonly grounded to the second ground terminals 2-3, and the shield effect can be reinforced.

Figure 9A:
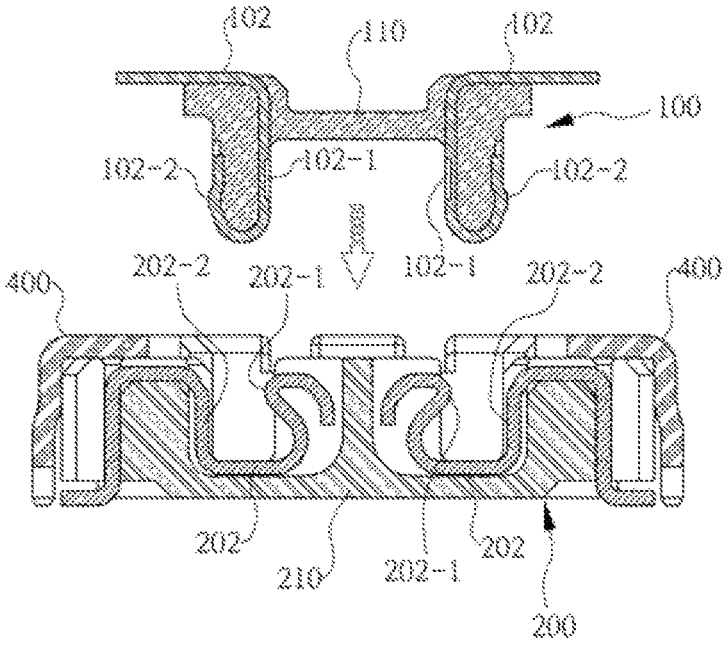
FIGS. 9A and 9B are views respectively illustrating states of a first terminal of the first connector unit and a second terminal of the second connector unit according to the present invention, before and after assembling.
Figure 9B:
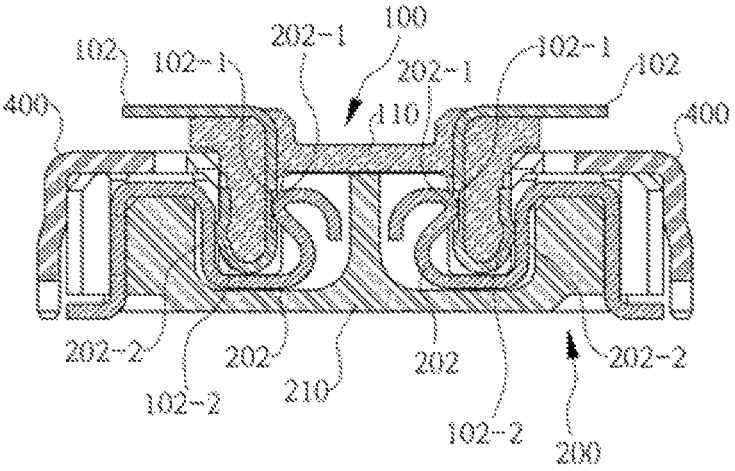

FIGS. 9A and 9B are views respectively illustrating states of the first terminal of the first connector unit and the second terminal of the second connector unit according to the present invention, before and after assembling.

As shown in FIGS. 9A and 9B, the U-shaped contact part of each of the first terminals 102 which is not soldered to the first board 1 is provided with the recessed main contact point 102-1 and the protruding sub-contact point 102-2 at opposite positions on the outer surface. Meanwhile, the U-shaped contact part of each of the second terminals 202, which corresponds to the U-shaped contact part of the first terminal 102 and is not soldered to the second board 2, is provided with a main contact point protrusion 202-1 and a sub-contact point surface 202-2 at opposite positions on the inner surface, in which the sub-contact point surface 202-2 has a vertical surface shape. Accordingly, when the first and second terminals 102 and 202 are completely assembled with each other as shown in FIG. 9B, the recessed main contact point 102-1 of the first terminal 102 is electrically connected to the main contact point protrusion 202-1 of the second terminal 202 by contact, and the protruding sub-contact point 102-2 of the first terminal 102 is guided and electrically connected to the sub-contact point surface 202-2 of the second terminal 202 by contact.

Unlike a related technology in which a locking protrusion is formed at a position above a sub-contact point surface of the U-shaped contact part of the second terminal 202 so as to prevent undesired separation of the first terminal from the second terminal, the present invention is advantageous in that the sub-contact point surface 202-2 is formed as a vertical surface, so the present invention can realize firm and efficient assembly of the first and second connector units using only the locking members 300 and the shield members 400 in which the first and second connector units are prevented from being undesirably separated from each other without using a related art locking protrusion, and the present invention can allow a user to easily know when assembly of the first and second terminals is complete from outside the connector.

The present invention may be embodied as a variety of different embodiments without being limited to the above-mentioned embodiment. In the drawings, to clearly illustrate the present invention, parts that do not relate to the above description are omitted. Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A shield and locking type board to board connector functioning to connect a first board and a second board to each other, the connector comprising:

a first connector unit having both a first base and a first terminal;

a second connector unit having a second base and a second terminal; and two shield members each having a shell shape, the shield members respectively provided on front and rear bases facing the second base such that the shield members arrest EMI (electromagnetic interference) noise, wherein each of the shield members comprises:

a vertical part covering an outer surface of the front and rear bases;

a horizontal part integrated with the vertical part, extending between both end portions thereof, and covering and enclosing an upper surface of the front and rear bases;

at least one ground protrusion formed on a lower edge of the vertical part; and a locking member stop part formed by being bent vertically downward in each of opposite ends of the horizontal part.

2. The shield and locking type board to board connector as set forth in claim 1, further comprising:

a locking member provided in the second connector unit so as to prevent the first connector unit from being removed outward by an outward movement thereof after the first connector unit is combined with the second connector unit in a close contact state.

3. The shield and locking type board to board connector as set forth in claim 2, wherein the locking member comprises:

a lower rib;

opposite vertical sides formed on opposite ends of the lower rib;

an upper rib formed between upper ends of the opposite vertical sides; and a pressure protrusion extending from the lower rib by being bent in a direction, wherein when the pressure protrusion is pressed downward, the opposite vertical sides and the upper rib are turned based on the lower rib, and when the upper rib is turned, the upper rib is placed on an outside end of a hooked part of the first connector unit, so the locking member holds the first connector unit and prevents the first connector unit from being removed, wherein the locking member is configured to turn around the lower rib in a state in which the position of the lower rib is maintained in the seat.

4. The shield and locking type board to board connector as set forth in claim 3, wherein the second connector unit is provided with a locking part in each of opposite ends of the second base, wherein the locking part includes:

a depression that is open upward; and a seat closed by a support part at an upper end thereof, wherein the lower rib of the locking member is seated in the seat so as to support the locking member in such a way that the locking member can be turned around the seat, and a part of the first connector unit is inserted into the depression, wherein, when the pressure protrusion is pressed down, the locking member is turned around the lower rib, and the upper rib is moved to a position at which the upper rib holds the outside end of the hooked part of the first connector unit.

5. The shield and locking type board to board connector as set forth in claim 4, wherein the first connector unit comprises:

a pressure part formed on the first base at a position facing the second base; and the hooked part formed on the first base at a position opposite to the pressure part, wherein when the first connector unit and the second connector unit are brought into close contact with each other, the pressure part of the first connector unit is inserted into the depression, and when the pressure protrusions of the locking member is pressed down, the locking member is turned around the lower rib seated in the seat, and the upper rib is moved to the position at which the upper rib holds the outside end of the hooked part.

6. The shield and locking type board to board connector as set forth in claim 4, wherein a space is formed inside the support part of the locking part such that the space is open upward and sideward, and the lower rib of the locking member is inserted downward into the space of the support part, and is moved outward on a bottom surface of the space of the support part so as to be seated in the seat.

7. The shield and locking type board to board connector as set forth in claim 6, wherein a vertical insert hole is formed in a lower end of the space of the support part, so, when a lower end of the locking member stop part is inserted into the vertical insert hole, the locking member stop part pushes the lower rib into the seat in the space of the support part.

8. The shield and locking type board to board connector as set forth in claim 2, further comprising:

an axial bent part formed in the vertical part of the shield member.

9. The shield and locking type board to board connector as set forth in claim 1, wherein a first ground protrusion is formed on each of opposite ends of the lower edge of the vertical part of each of the shield members, and a plurality of second ground protrusions are formed on the lower edge of the vertical part at spaced locations between the first ground protrusions formed on the opposite ends of the vertical part, and first ground terminals are formed on a second board that is placed below the shield members such that the first ground terminals are electrically connected to the first ground protrusions, and a plurality of second ground terminals are formed between the first ground terminals on the second board at locations corresponding to the plurality of second ground protrusions.

10. The shield and locking type board to board connector as set forth in claim 9, wherein electric terminals are arranged on the second board in a line along with the first and second ground terminals so as to be electrically connected to the second terminals, wherein the second ground terminals further protrude outward than the electric terminals.

11. The shield and locking type board to board connector as set forth in claim 10, wherein the second terminals and the second ground protrusions are commonly connected to the second ground terminals.

12. The shield and locking type board to board connector as set forth in claim 1, wherein a U-shaped contact part of the first terminal which is not soldered to the first board is provided with a recessed main contact point and a protruding sub-contact point at opposite positions on an outer surface, and a U-shaped contact part of the second terminal which is not soldered to the second board is provided with a main contact point protrusion and a sub-contact point surface at opposite positions on an inner surface, in which the sub-contact point surface has a vertical surface shape, the main contact point protrusion corresponds to the recessed main contact point, and the sub-contact point surface corresponds to and is guided by the protruding sub-contact point.

13. The shield and locking type board to board connector as set forth in claim 1, wherein a left to right width of the first board is smaller than a left to right width of the first connector unit.

* * * * *